United States Patent [19]

Staehlin

[11] 4,415,130

[45] Nov. 15, 1983

[54] MISSILE SYSTEM WITH ACCELERATION INDUCED OPERATIONAL ENERGY

[75] Inventor: John H. Staehlin, Lutherville, Md.

[73] Assignee: Westinghouse Electric Corp., Pittsburgh, Pa.

[21] Appl. No.: 224,347

[22] Filed: Jan. 12, 1981

[51] Int. Cl.[3] ..... F42B 15/00; F41G 7/22

[52] U.S. Cl. ..... 244/3.15; 102/207

[58] Field of Search ..... 244/3.15, 3.16, 3.17, 244/3.18, 3.19, 3.2; 102/207, 208, 209, 210, 223, 224

[56] References Cited

U.S. PATENT DOCUMENTS

| | | | |
|---|---|---|---|
| 3,081,051 | 3/1963 | Robinson, Jr. | 244/3.15 |
| 3,111,088 | 11/1963 | Fisk | 244/3.16 |
| 3,324,317 | 6/1967 | Hazelet | 102/210 |
| 3,843,075 | 10/1974 | Weber et al. | 244/3.15 |
| 4,193,567 | 3/1980 | McCarty, Jr. | 244/3.16 |

*Primary Examiner*—Charles T. Jordan

*Attorney, Agent, or Firm*—W. E. Zitelli

[57] ABSTRACT

A missile system is disclosed which collects and stores energy during the early stages of flight of a missile at a time when the acceleration forces on the missile are the greatest and thereafter, regulates the stored energy to at least one mechanism on board the missile for operation thereof. More specifically, the missile system includes a main support housing section and a nose cone section which is slidably, mechanically interconnected to the housing section. During the early stages of flight, the nose cone section is caused to move with respect to the housing section under the induced acceleration of the missile. Means are provided on board the missile to collect and store the energy resulting from the acceleration induced movement of the nose cone section with respect to the housing section and to provide the stored energy in a regulated fashion to at least one mechanism disposed on the missile for operation thereof during the flight time of the missile.

10 Claims, 6 Drawing Figures

MISSILE SYSTEM WITH ACCELERATION INDUCED OPERATIONAL ENERGY

BACKGROUND OF THE INVENTION

The present invention relates to missile systems, in general, and more particularly, to a missile system which collects and stores energy resulting from the induced acceleration forces on the missile during early stages of flight and which regulates the stored energy to at least one mechanism of the missile for operation thereof during the flight time of the missile.

Recently, missile systems have been proposed to include seeker type radars disposed on board the missile to govern the missile dynamics during the flight thereof to guide the missile pay load to a prespecified target area. Generally, in these proposed missile systems, a radar antenna is enclosed in the nose cone, which acts as a radome, and is mechanically scanned by a gimbal drive mechanism in at least one axial direction, say the elevation axis, for example. Since the missile flight is conducted proposedly at supersonic speeds resulting in a very short duration flight before impact, the requirements for the antenna gimbal drive mechanism dynamics include fast slewing and high angular acceleration. In fact, one example of a performance scenario for a modern missile system may include:

(a) Elevation Gimbal Inertia=0.5 lb-in-sec.$^2$
(b) Gimbal Angular Acceleration (max.)=15,000-°sec.$^2$
(c) Gimbal Angular Velocity=500°/sec.
(d) Duration High Sustained "G" Levels=2 sec. (i.e. approximately 500 "g" flight)
(e) Duration of Gimbal Operation=6 sec.
(f) Total Flight Time=8 sec.

In some recent proposals, the antenna gimbal drive mechanisms were to include large electric servo motors to satisfy the power requirements of high angular acceleration and fast slewing in actuating the antenna from one position to another. It was contemplated that storage batteries may be provided on board the missile to supply energy to the proposed electric servo motors during the flight time of the missile. Since both the motors and accompanying storage batteries are very heavy, this proposal resulted in a considerable weight disadvantage. In addition, since the deployment time of the missile is generally not predictable, the power supply batteries may require storage, in some cases, on board the missile during the shelf life thereof which may be many months or even years. Evidently, a great deal of testing and maintenance of the batteries can be expected to ensure the availability and adequacy of energy of the power supply at the time of missile deployment. Otherwise, the storage battery energy may be depleted over the time of the shelf life of the missile resulting in an insufficient energy source when needed.

Another proposal offered that the antenna gimbal drive mechanism may be powered hydraulically or pneumatically using conventional piston-cylinder assemblies coupled with a regulatory device and storage accumulator. While this proposal eliminates most of the weight disadvantages associated with the much heavier motors and batteries of the electrically powered system, it remains that any attempt to store energy even in hydraulic or pneumatic form, for example, on board the missile will still require extensive testing and maintenance periodically over the shelf life of the missile. To alleviate this effort, some recent suggestions contemplated pressurizing the storage accumulator with the specified fluid just prior to deployment of the missile to provide an adequate supply of energy throughout the flight time of the missile. However, since time of deployment is not predictable and may even be triggered instantaneously by some predetermined event, then any time taken to energize the on board storage accumulators prior to deployment will delay the deployment of the missile and under some conditions, diminish the effectiveness of the strike or defense capability thereof.

From the above discussion, it appears that elimination of the on board antenna operational energy storage during the shelf life of the missile system would alleviate the apparent extensive testing and maintenance effort associated therewith. However, some form of energy must be substituted therefor to ensure adequate energy for operation of the missile radar antenna for the specified times during the missile flight. It also appears that pneumatic, hydraulic or a combination thereof provides a weight advantage in the embodying apparatus thereof as a form for storing and supplying energy to the operation of the radar antenna as compared with an all electric driven radar antenna. The present invention, which is described in a preferred embodiment form herebelow, intends to provide apparatus which obtains and supplies energy to satisfy the radar antenna operational power requirements during the missile flight while avoiding the necessity of storing energy during the shelf life of the missile system. Accordingly, the new missile system permits instantaneous deployment with no unnecessary delays for energy supply storage purposes.

SUMMARY OF THE INVENTION

In accordance with the present invention, a missile system comprises a main support housing section and a nose cone section. The main support housing section has two ends which are oppositely disposed along a longitudinal axis of the missile. Included in the housing section is a propulsion mechanism operative to effect thrust at one end thereof to cause acceleration of the missile in at least a direction along the longitudinal axis thereof. The nose cone section is slidably, mechanically interconnected to the other end, opposite the one end, of the housing section and is operative to move with respect to the housing section under the induced acceleration of the missile. Further included in the missile system is a means which is operative to collect and store the energy resulting from the acceleration induced movement of the nose cone section with respect to the housing section. At least one mechanism is disposed on the missile and requires energy for operation during the flight time of the missile. Finally, a regulating means is included as part of the missile system and operative to provide energy from the energy storage means to the at least one mechanism for operation thereof during the flight time of the missile.

More specifically, a portion of the inner surface of the nose cone section is slidably affixed in juxtaposition preferably with a portion of the outer surface at the other end of the housing section to promote surface-to-surface translational movement of the nose cone section with respect to the housing section substantially in a direction along the longitudinal axis thereof. Moreover, the energy collection and storage means may include: a fluid containing means which is mechanically coupled to both the nose cone and main support housing sections and operative to displace an amount of fluid proportional to the acceleration induced movement between the nose cone and main support housing sections; and fluid storage means coupled to the fluid containing means for accepting the amount of displaced fluid therefrom and for storing the displaced fluid at a potential energy state. The at least one mechanism further includes means responsive to the fluid supply for operation thereof. In addition, the regulating means includes a fluid regulation means mechanically coupling the fluid storage means to the at least one mechanism to regulate the supply of fluid therebetween for operation of the at least one mechaism. Thus, the potential energy source and fluid storage form in the fluid storage means is converted to operational energy as regulated fluid in operating the at least one mechanism of the missile system.

Furthermore, the at least one mechanism may include a gimbaled antenna assembly having at least one pair of push-push type piston-cylinder assemblies which are responsive to fluid supplied from the fluid regulating means to operate the gimbaled antenna assembly about at least one axis. In one embodiment, the gimbaled antenna assembly is included as part of the nose cone section of the missile.

DESCRIPTION OF THE PREFERRED EMBODIMENTS

Figure 1:
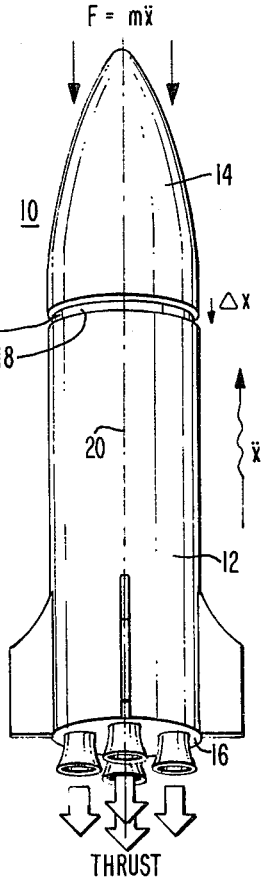
FIG. 1 illustratively depicts a missile system with a main support housing section and a nose cone section suitable for embodying the principles of the present invention.

In FIG. 1 is illustratively depicted a missile system 10 with a main support housing section 12 and a nose cone section 14. The housing section 12 may have two ends 16 and 18 oppositely disposed along a longitudinal axis 20 of the missile. The housing section 12 may include a propulsion mechanism (not shown) operative to effect thrust at one end 16 thereof causing acceleration $\ddot{x}$ of the missile 10 at least in a direction along the longitudinal axis 20 thereof. The nose cone section 14 may be slidably, mechanically interconnected to the end 18 of the housing section 12 and may be operative to move with respect to the housing section 12 under the induced acceleration ($F=m\ddot{x}$) of the missile. The movement of the nose cone section 14 with respect to the housing section 12 is depicted as $\Delta x$ in FIG. 1.

More specifically, a portion of the inner surface of the nose cone section may be slidably affixed in juxtaposition peripherally with a portion 22 of the outer surface of the other end 18 of the housing section 12 to promote surface-to-surface translational movement ($\Delta x$) of the nose cone section 14 with respect to the housing section 12 substantially in a direction along the longitudinal axis 20 thereof.

It has been discovered that during early stages of the flight, say, for example, the first two seconds, the accelerations on the missile may exceed 500 "g"'s. Fortuitously, in most performance scenarios, the missile antenna gimbal drives are not required to operate during this early flight stage. However, during the remainder of the flight, the antenna gimbal drives (not shown) may be specified to operate at full performance capabilities similar to those provided in the example of the background section. In accordance with the present invention then, the missile system 10 makes use of the high "g" levels of the early missile flight to collect and store the necessary energy for operating the antenna gimbal drives in potential energy form and thereafter, regulates the dissipation of this energy at the required power levels for operation of the antenna gimbal drives during the remainder of the missile flight which may be on the order of 6 seconds, for example.

Figure 2:
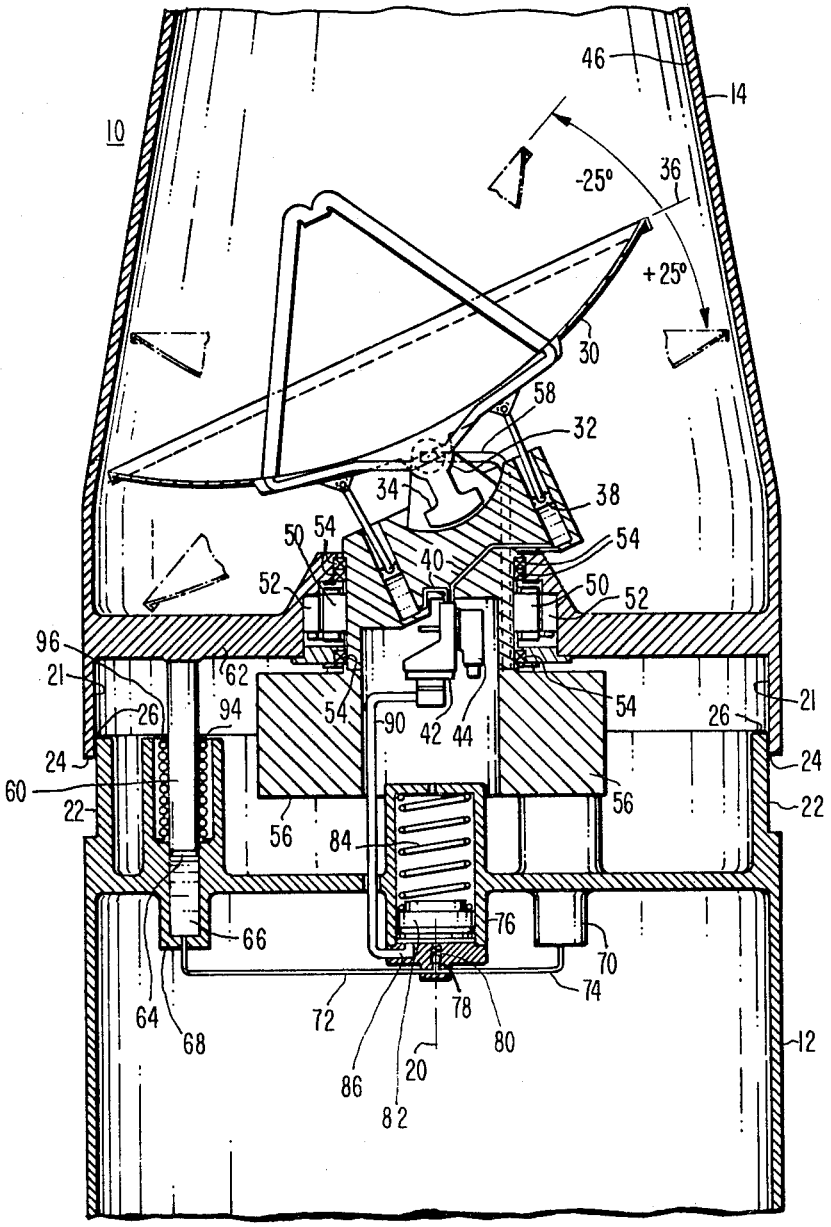
FIG. 2 is an illustrative cross-sectional diagram of the relevant apparatus of the missile system as depicted in FIG. 1.

An illustrative cross-sectional diagram of the relevant apparatus of the missile system 10 is depicted in FIG. 2. The cross-sectional view includes portions of the main support housing and nose cone sections 12 and 14, respectively, and the slidable surface-to-surface interface between the sections 12 and 14 including the inner surface 21 of a portion of the nose cone section 14 and the outer surface 22 of a portion of the housing section 12. Moreover, there may exist a slight clearance at 24 between the surfaces 21 and 22 and in addition, a wiper 26 which may be disposed peripherally about the inside of the clearance 24 to provide for some absorbance.

For the present embodiment, the nose cone section 14 includes an antenna assembly which may be a conventional parabolic reflector antenna radiator, for example, as shown at 30 and which may be mounted to the inner nose cone section structure with a stabilized and dynamically balanced gimbal as shown at 32. With this antenna assembly positional mounting, the inner surfaces 46 of the nose cone section 14, which may be comprised of a ceramic material, acts as a redome to the antenna assembly 30.

In the present embodiment, the antenna assembly 30 may be driven at least in a direction about the elevation axis through an elevation angle which may be limited to $\pm 25°$ with respect to a predetermined antenna position, such as that shown at 36, for example.

A set of push-push piston/cylinders shown at 38 may be utilized, in the present embodiment, to drive the gimbaled antenna apparatus fluidically from one position to another. Fluid lines 40 may be provided to the push-push piston-cylinder combinations 38 from a conventional fluidic servo valve 42 which may be coupled to and governed by a conventional servo mechanism 44. In some cases, the valve and servo mechanism 42 and 44, respectively, may be operated in a closed-loop fashion with position feedback from the antenna assembly.

In addition to the antenna and elevation gimbal drive assemblies, the mass of the nose cone section 14 may additionally include one or more conventional roll motors, and associated housing and bearings depicted at 50, 52 and 54, respectively. Furthermore, a conventional radar system 56 may be included in the nose cone section 14 to provide the radiating signals to the antenna radiator 30 over a set of waveguide lines 58. In addition, the waveguide lines 58 may also be used to conduct the received signals from the antenna apparatus 30 to the radar system 56. Therefore, the elements just described in connection with the nose cone section 14 and including the structural support members thereof constitute substantially, for the present embodiment, the overall mass of the nose cone section 14.

As related to the present invention, at least one rod 60 may be coupled rigidly to a portion 62 of the structural body of the nose cone section 14 and the rod 60 may have a portion 64 thereof adapted for use as a piston. A corresponding cylinder 66 may be coupled rigidly to a portion 68 of the structural body of the main support housing section 12. The cylinder 66 may be aligned to permit insertion of its corresponding rod piston 64 partially therein as part of the slidable mechanical interconnection between the nose cone and main support housing sections 14 and 12, respectively. A fluid may be disposed in each cylinder 66 under the rod piston portion 64. Each piston-cylinder combination 64–66 may be operative to displace an amount of fluid from the cylinder in response to the movement of the piston 64 in the cylinder 66 which may result from the acceleration induced movement ($\Delta x$) of the nose cone section 14 with respect to the main support housing section 12. The amount of displaced fluid may be proportional to the energy associated with the acceleration induced movement ($\Delta x$). Another rod-piston-cylinder apparatus combination may be included at the block depicted at 70. In the preferred embodiment, there may be as many as three of the rod-piston-cylinder combinations disposed circumferentially about the longitudinal axis 20 of the missile.

Fluid lines 72 and 74, for example, may be used to conduct the displaced fluid from their respective piston-cylinder combinations, like 64–66, for example, to an accumulator depicted at 76. The displaced fluid may enter the accumulator through an input passage 78. In a preferred embodiment, the input passage 78 may include a one-way check valve 80 which permits passage of fluids solely from the fluid containing cylinders, like 66 for example, to the accumulator 76 for storage therein. Also, in the preferred embodiment, the accumulator 76 may be a cylinder having a piston 82 and spring 84 assembled between the piston 82 and inside wall of the cylinder, wherein the piston-spring combination 82 and 84 may be configured mechanically to maintain a pressure on the fluid stored in the cylindrical structure 76.

The accumulator 76 may additionally include an output passage 86 adapted for passing the stored fluid out from the accumulator 76 to the fluid regulating means 42. A flexible type fluid line 90 may be coupled between the output passage 86 and fluid regulating valve 42. The fluid line 90 may be assembled in a coiled configuration to flex during the acceleration induced movement of the nose cone section 14 with respect to the housing section 12.

The piston-cylinder combinations, exemplified by 64-66, for example, which provide in part the flexible mechanical interconnection between the nose cone section 14 and housing section 12 of the missile, are operative, in the present embodiment, to collect and store the energy resulting from the acceleration induced movement ($\Delta x$) of the nose cone section 14 with respect to the housing section 12, the displaced amount of fluid therefrom being proportional to the acceleration induced movement between the aforementioned sections. The accumulator 76 and associated spring 84 and piston 82 disposed therein provide a fluid storage means for accepting the amount of displaced fluid from the piston-cylinder assemblies and for storing the displaced fluid therein at a potential energy state. In addition, the servo valve 42 and servo mechanism 44 for control thereof constitute a regulating means which is mechanically coupled via flexible fluid line 90 to the fluid storage accumulator 76 and regulates the supply of fluid therebetween for the drive operation of the gimbal mechanism 32 of the antenna assembly 30. Accordingly, the potential energy in fluid storage form in the fluid storage accumulator 76 is converted to operational energy as regulated fluid via line 90 and fluid regulator 42 in operating at least one mechanism (gimbaled antenna assembly) of the missile system.

Figure 3:
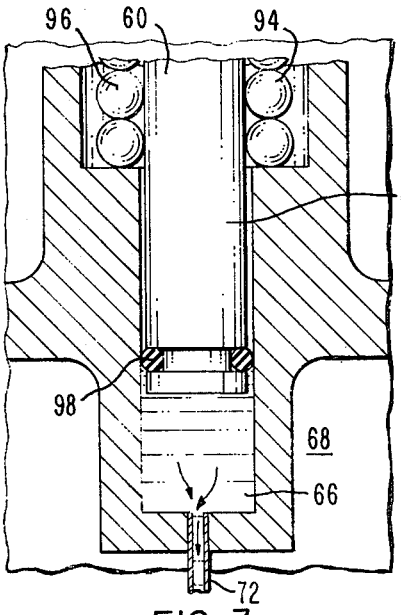
FIG. 3 is a cross-sectional illustrative view of one embodiment of a piston-cylinder assembly for collecting energy suitable for use in the embodiments of FIGS. 1 and 2.

A cross-sectional illustrative view of one embodiment of a piston-cylinder assembly for collecting energy from the acceleration induced movement between the nose cone and housing sections is depicted in greater detail in FIG. 3. Referring to FIG. 3, the piston portion 64 of the rod 60 is shown partially disposed in the cylinder 66. To provide for low friction movement between the piston portion 64 and the housing section structure 68 in this embodiment, one or more conventional recirculating ball bearing assemblies, as shown at 94 and 96, have been provided. In addition, a conventional seal 98 may be disposed around the periphery of the piston portion 64 near the bottom thereof to protect against fluid escaping through the clearances between the piston portion 64 and the inner side walls of the cylinder 66. In operation, as the nose cone section 14 is forced to move with respect to the housing section 12 under the induced acceleration of the missile, the piston portion 64 proceeds downward into the cylinder section 66 to displace an amount of fluid from the cylinder 66 through the fluid line 72 coupled thereto, the displaced fluid being proportional to the acceleration induced movement.

Figure 4:
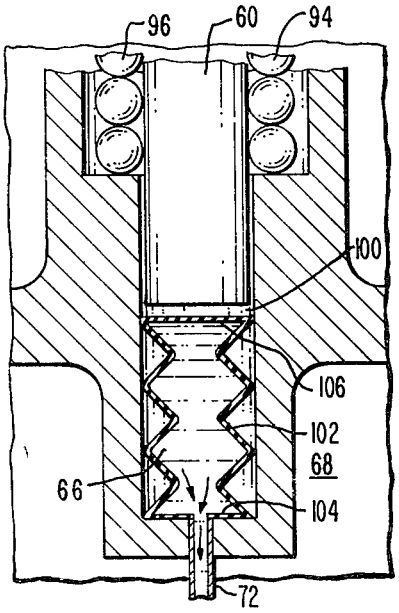
FIG. 4 is a cross-sectional illustrative view of another embodiment of a rod/bellows assembly for collecting energy also suitable for use in the embodiment of FIGS. 1 and 2.

An alternate embodiment which may also be suitable for the collection of energy resulting from the acceleration induced movement between the sections 14 and 12 is shown in cross-sectional illustrative detail in FIG. 4. In this diagram of the alternate embodiment, the rod 60 which is rigidly coupled to the structural body of the nose cone section 14 may be disposed within a cavity 100 which may be a part of the structure 68 of the housing section 12. Additionally included in the cavity 100 may be a conventional bellows 102 which may contain a fluid therein. The bellows 102 may have one end 104 rigidly secured against or coupled to the structural body 68 of the main support housing section 12 and another end 106 responsive to the movement of its corresponding rod 60 to displace an amount of fluid from the bellows 102 in proportion to the acceleration induced movement of the nose cone section 14. In a similar manner as that of the embodiment described in connection with FIG. 3, the displaced fluid may be conducted through fluid line 72 to the fluid storage accumulator 76 for storage therein at a potential energy state.

Figure 5:
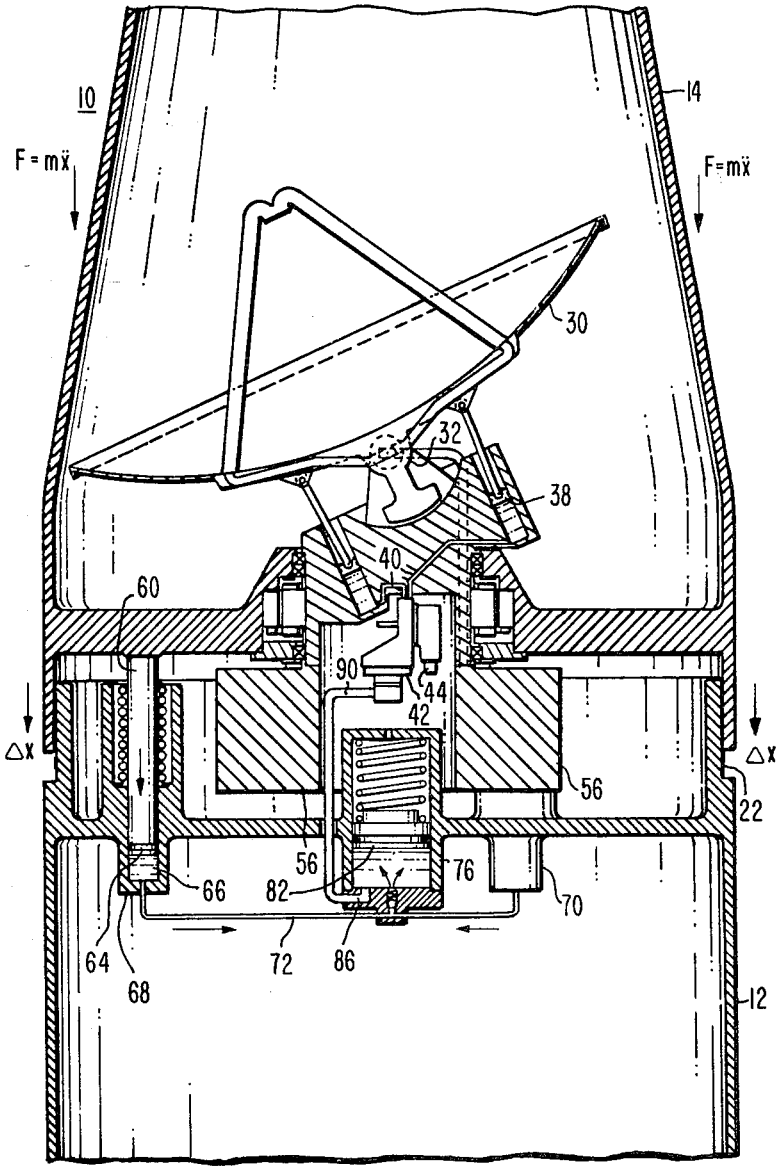
FIG. 5 is a cross-sectional illustrative diagram provided to exemplify the operation of collecting energy during the early stages of flight of the missile system depicted in FIGS. 1 and 2.

The cross-sectional illustrative view of FIG. 5 is provided in the application to exemplify the operation of collecting energy during the early stages of flight at a time when the acceleration of the missile is the greatest. As was described supra, the acceleration forces on the missile nose cone section 14 during this early stage may be as high as 500 "g"'s in some cases. Assuming that the mass weight of the nose cone section 14 is approximately 30 lb., then the distributed forces on the nose cone 14, denoted by the equations $F=m\ddot{x}$ in the diagram of FIG. 5, may be equal to $500\times30=15{,}000$ pounds. As the acceleration induced movement denoted as $\Delta x$ between the nose cone section 14 and housing section 12 is effected, the piston portion 64 of the rod 60 travels within the cylinder 66 commensurate therewith thereby displacing a proportional amount of fluid from the cylinder 66. The displaced fluid travels through fluid line 72 and is stored in the spring loaded accumulator 76. Thus, in the present example, for every inch of travel of the integral piston 64 in the cylinder 66, 15,000 inch-lb. of torque may be stored in the accumulator 76.

It is understood that in the cases in which more than one piston cylinder energy collection assemblies are included such as that depicted at 70, a composite amount of fluid displaced from all of the storage collection assemblies may be transferred and stored in the fluid storage assembly 76. In the diagram of FIG. 5, the movement of the nose cone section 14 with respect to the section 12, the movement of the piston portion 64 in the cylinder 66, and the movement of the displaced fluid from the cylinder 66 to the storage accumulator 76 are all depicted by solid line arrows, the arrow point denoting the direction of the travel or movement as the case may be.

Once having the fluid stored under pressure in the accumulator 76 during the early stages of flight, the antenna assembly 30 and gimbaled mechanism 32 may be operated during the remaining flight time or portion thereof utilizing the stored fluid. In one example, the torque required to drive the antenna elevation gimbal 32 may be:

$$\text{Torque}=\ddot{J}\theta=0.51\ \text{lb.-in.-sec}^2\times15{,}000°/\text{sec}^2 \quad (1)$$

$$\text{Torque}=\ddot{J}\theta=0.51\ \text{lb.-in.-sec}^2\times262\ \text{radians/sec}^2 \quad (2)$$

$$\text{Torque}=131\ \text{in.-lb.} \quad (3)$$

$$T\ (\text{assumed})=1.5\times131\ \text{in.-lb.}=196\ \text{in.-lb.} \quad (4)$$

In this scenario, if it is further assumed that the gimbal mechanism 32 is traveling at its maximum angular velocity (500° per second) for the entire flight (8 seconds), then the total angular excursion may be:

$$\ddot{\theta}=500°/\text{sec.}\times8\ \text{sec.}=4{,}000°=72\ \text{radians} \quad (5)$$

Then, the total torque required may be:

$$T\ (\text{total})=196\ \text{in.-lb.}\times72\ \text{radians}=14{,}112\ \text{in.-lb.} \quad (6)$$

For this example then, the available torque may be 15,000 inch-pounds, and as calculated above, the required torque may be 14,112 inch pounds. Hence, these estimates of energy storage in accordance with the operation of the present embodiment exhibits good potential for achievement of their intended purpose. Of course, these calculations are independent of any forces associated with the nose cone drag resulting from the expected high velocity flight which could be usable for storing additional energy in the energy storage accumulator.

Figure 6:
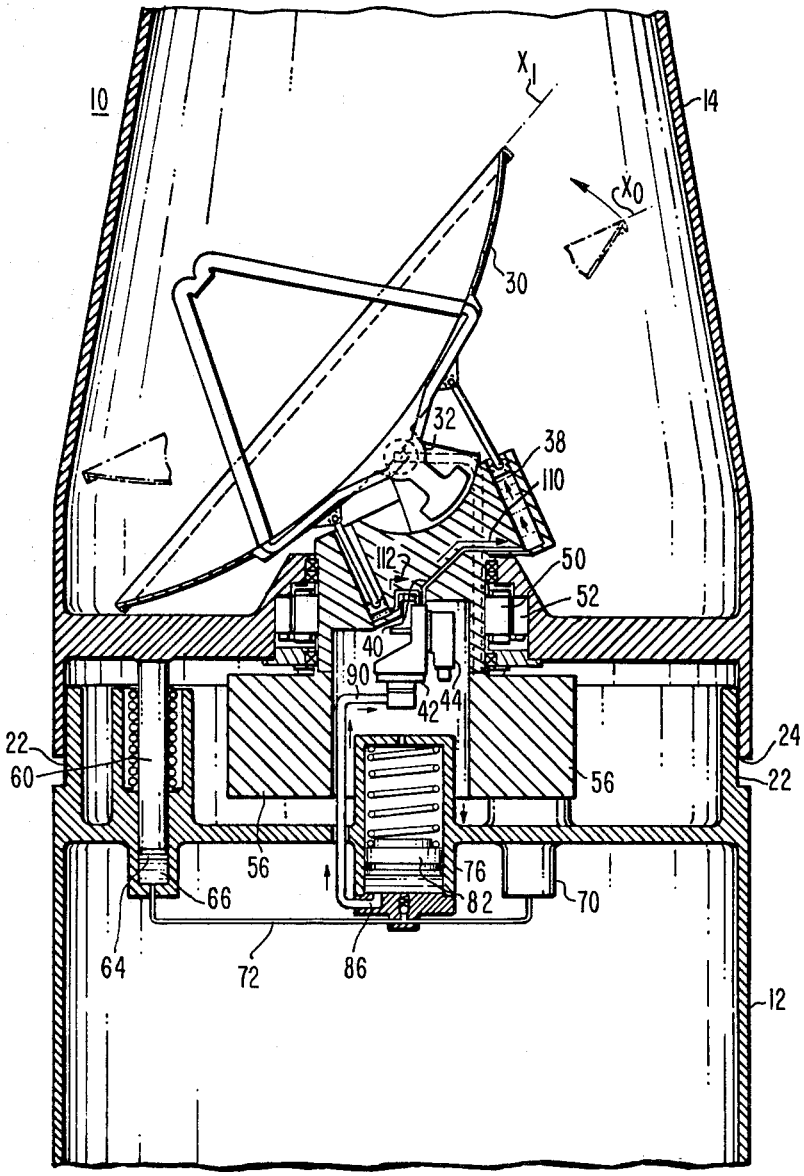
FIG. 6 is another illustrative cross-sectional diagram depicting an operation of regulating the stored energy during the flight of the missile system embodied by the diagrams of FIGS. 1 and 2.

In addition, the elevation gimbal mechanism 32 may be designed substantially balanced about the axis of rotation and may be suspended on low friction flexural pivots or on low frictional needle bearings, as the case may be. Accordingly, this combination provides for very efficient movement of the antenna assembly 30 from one position $X_0$, to another position $X_1$, for example, as depicted in the embodiment of FIG. 6. For the example used, the entire life of the gimbaled antenna assembly on board the missile may be approximately six seconds and the energy for operation thereof is completely generated and supplied during the early stages of supersonic flight of the missile, say approximately two seconds, for example.

FIG. 6 is an illustrative cross-sectional diagram of an embodiment, similar to that of FIG. 2, depicting an exemplary operation of regulating the stored fluid from the accumulator 76 to the push-push piston cylinders 38 for operating the gimbaled antenna assembly 30 from one position $X_0$ to a new position $X_1$, for example. As the gimbaled antenna assembly 30 is actuated for operation by the radar 56 disposed on board the missile 10, the servo valve 42 and associated servo mechanism 44 may be governed by the radar 56, for example, to regulate the fluid from the storage accumulator 76 through flex fluid line 90 and to one or the other of the push-push piston-cylinder assemblies 38 via one of the fluid lines 40. The solid line arrows of FIG. 6 depict the motion of the fluid as it exits the accumulator 76 through the output port 86 thereof and passes through the flexible fluid line 90 to the servo valve 42.

In the operational example provided by the diagram of FIG. 6, the servo mechanism 44 governs the servo valve 42 to conduct fluid through the one line 40 to the upper of the push-push piston-cylinder assemblies 38 as denoted by the solid arrow 110. In addition, the servo valve 42 may also be controlled to dump the fluid from the lower of the push-push piston-cylinder assemblies 38 through the other of the lines 40 as denoted by the solid line arrow 112. The supply and dumping of fluid as regulated by the servo valve 42 in the manner just described causes the gimbal mechanism 32 and connected antenna assembly 30 to move in the direction from position $X_0$ to $X_1$, for example.

Conversely, if the servo valve 42 regulates the fluid from the storage assembly 76 to supply fluid to the lower of the push-push piston-cylinder assemblies 38 and dumps the fluid from the upper piston assembly, the gimbal mechanism 32 and connected antenna assembly 30 is moved in the reverse direction, say from $X_1$ to $X_0$, for example. Thus, the regulation of fluid in the manner just described may operate the push-push piston-cylinder assemblies 38 to drive the gimbaled antenna assembly 30 through various positions during the duration of the missile flight utilizing the stored fluid in the accumulator 76.

As indicated by the foregoing description of the preferred embodiment, the fluid collection and storage assemblies of the missile system 10 may be dimensioned in accordance with either a pneumatic or hydraulic fluid substance, to provide for sufficient total torque required for driving the gimbaled antenna assembly 30 through its total maximum angular excursions for the duration of the missile flight time or portion thereof. Furthermore, while the embodiment described hereabove in connection with FIGS. 1 through 6 is preferred for the present invention, it is apparent, to anyone skilled in the pertinent art, however, that reasonable modifications and additions may be made to the preferred embodiment without deviating from applicant's inventive principles. Therefore, the invention should not be limited to any one embodiment, but construed in regard to the breadth and broad scope of the claims in the instant application.

I claim:

1. A missile system comprising:

a main support housing section having two ends oppositely disposed along a longitudinal axis of said missile, said housing section including a propulsion mechanism operative to effect thrust at one end thereof causing acceleration of said missile at least in a direction along the longitudinal axis thereof;

a nose cone section slidably, mechanically interconnected to the other end, opposite said one end, of said housing section and operative to move with respect to said housing section under the induced acceleration of said missile;

a fluidic system operative to collect and store the energy resulting from the acceleration induced movement of said nose cone section with respect to said housing section;

at least one mechanism disposed on said missile and which requires energy for operation during the flight time of the missile; and a regulating means operative to provide energy from said fluidic energy storage system to said at least one mechanism for operation thereof during the flight time of said missile.

2. The missile system in accordance with claim 1 wherein a portion of the inner surface of the nose cone section is slidably affixed in juxtaposition peripherally with a portion of the outer surface at the other end of the housing section to promote surface-to-surface translational movement of the nose cone section with respect to the housing section substantially in a direction along the longitudinal axis thereof.

3. The missile system in accordance with claim 1 wherein the fluidic energy collection and storage system includes:

fluid containing means mechanically coupled to both the nose cone and main support housing sections and operative to displace an amount of fluid proportional to the acceleration induced movement between the nose cone and main support housing sections; and fluid storage means coupled to the fluid containing means for accepting said amount of displaced fluid therefrom and for storing said displaced fluid at a potential energy state;

wherein the at least one mechanism includes means responsive to fluid supply for operation thereof; and wherein the regulating means includes a fluid regulation means mechanically coupling said fluid storage means to the at least one mechanism to regulate the supply of fluid therebetween for operation of the at least one mechanism, whereby the potential energy source in fluid storage form in the fluid storage means is converted to operational energy as regulated fluid in operating the at least one mechanism of the missile system.

4. The missile system in accordance with claim 3 wherein the fluid containing means includes:

at least one rod coupled rigidly to the structural body of the nose cone section and having a portion thereof adapted for use as a piston;

a corresponding cylinder for the piston portion of each rod coupled rigidly to the structural body of the main support housing section, each cylinder being aligned to permit insertion of its corresponding rod piston portion partially therein as part of the slidably mechanical interconnection between the nose cone and main support housing sections; and a fluid disposed in each cylinder under said rod piston portion, each piston-cylinder combination being operative to displace an amount of fluid from said cylinder in response to the movement of the piston in the cylinder which results from the acceleration induced movement of the nose cone section with respect to the main support housing section, whereby the amount of fluid is proportional to the energy associated with the acceleration induced movement.

5. The missile system in accordance with claim 3 wherein the fluid containing means includes:

at least one rod coupled rigidly to the structural body of the nose cone section; and a corresponding bellows for each of said rods, each bellows including a fluid and having one end coupled rigidly to the structural body of the main support housing section and another end responsive to movement of its corresponding rod to displace an amount of fluid from said bellows in proportion to the acceleration induced movement of the nose cone section, said rod movement resulting from the acceleration induced movement of the nose cone section with respect to the main support housing section, whereby the amount of fluid displaced is proportional to the energy associated with the acceleration induced movement of the nose cone section.

6. The missile system in accordance with claim 3 wherein the fluid storage means includes an accumulator coupled to the fluid containing means for storage of the displaced fluid therefrom, said accumulator including an input passage adapted for passing fluid into said accumulator from the fluid containing means, means for maintaining a pressure on said stored fluid in said accumulator, and an output passage adapted for passing fluid out from said accumulator to the fluid regulating means.

7. The missile system in accordance with claim 6 wherein the input passage of the accumulator includes a one-way check valve which permits passage of fluid solely from the fluid containing means to the accumulator for storage under pressure therein.

8. The missile system in accordance with claim 6 wherein the accumulator comprises a cylindrical structure; a piston; and a spring assembled to said piston, said piston-spring assembly being disposed within said cylinder and configured mechanically to maintain a pressure on the fluid stored in said cylinder.

9. The missile system in accordance with claim 3 wherein the at least one mechanism includes a gimbaled antenna assembly having at least one pair of push-push type piston-cylinder assemblies which are responsive to fluid supplied from the fluid regulating means to operate said gimbaled antenna assembly about at least one axis.

10. The missile system in accordance with claim 9 wherein the gimbaled antenna assembly is included as part of the nose cone section of the missile.

* * * * *